US009625212B2

(12) United States Patent
Nakano et al.

(10) Patent No.: US 9,625,212 B2
(45) Date of Patent: Apr. 18, 2017

(54) WALKING-BEAM TYPE HEATING FURNACE

(71) Applicant: CHUGAI RO CO., LTD., Osaka-shi, Osaka (JP)

(72) Inventors: Masaaki Nakano, Osaka (JP); Hideyuki Sawada, Osaka (JP)

(73) Assignee: CHUGAI RO CO., LTD., Osaka-shi (JP)

( * ) Notice: Subject to any disclaimer, the term of this patent is extended or adjusted under 35 U.S.C. 154(b) by 304 days.

(21) Appl. No.: 14/118,803

(22) PCT Filed: Jan. 11, 2013

(86) PCT No.: PCT/JP2013/050357
§ 371 (c)(1),
(2) Date: Nov. 19, 2013

(87) PCT Pub. No.: WO2013/190856
PCT Pub. Date: Dec. 27, 2013

(65) Prior Publication Data

US 2015/0050611 A1 Feb. 19, 2015

(30) Foreign Application Priority Data

Jun. 22, 2012 (JP) ..... 2012-140299

(51) Int. Cl.
*F27B 9/20* (2006.01)
*F27B 9/24* (2006.01)
(Continued)

(52) U.S. Cl.
CPC ..... *F27B 9/205* (2013.01); *C21D 1/34* (2013.01); *C21D 9/00* (2013.01); *C21D 9/0006* (2013.01);
(Continued)

(58) Field of Classification Search
CPC ..... F27B 9/201; F27B 9/202
(Continued)

(56) References Cited

U.S. PATENT DOCUMENTS 3,471,134 A * 10/1969 Cone ..... F27B 9/205 198/774.3
4,025,298 A * 5/1977 Tokitsu ..... F27D 3/024 198/773
(Continued)

FOREIGN PATENT DOCUMENTS

JP 55-093711 A 7/1980
JP 58-151659 U 10/1983
(Continued)

OTHER PUBLICATIONS

Notification of Transmittal of Translation of the International Preliminary Report on Patentability (form PCT/IB/338) of International application No. PCT/JP2013/050357, mailing date of Dec. 31, 2014 with forms PCT/ISA/237, PCT/IB/326 and PCT/IB/373 (16 pages).
(Continued)

*Primary Examiner* — Gregory A Wilson
(74) *Attorney, Agent, or Firm* — Westerman, Hattori, Daniels & Adrian, LLP

(57) ABSTRACT

In a heating furnace 10 where elongate workpieces fed into the heating furnace are sequentially transferred on fixed beams by walking beams from an inlet area to an outlet area, concaves to retain the workpieces are formed at least on the walking beams. A concave in the inlet area for heating the workpieces is increased in width in a transfer direction, while a concave in the outlet area where the heated workpieces are wholly heated to a uniform temperature and retained in position is formed in a corrugated configuration. Despite curving of an elongate workpiece being heat treated as transferred by walking beams in a direction crossing a
(Continued)

longitudinal direction of the workpiece, this ensures that the curved workpiece is properly transferred and adequately corrected for the curving.

6 Claims, 5 Drawing Sheets

(51) Int. Cl.
*C21D 9/00* (2006.01)
*C21D 1/34* (2006.01)

(52) U.S. Cl.
CPC ..... *C21D 9/0018* (2013.01); *F27B 9/201* (2013.01); *F27B 9/202* (2013.01); *F27B 9/24* (2013.01)

(58) Field of Classification Search
USPC ..... 432/122, 123
See application file for complete search history.

(56) References Cited

U.S. PATENT DOCUMENTS 4,102,449 A * 7/1978 Shufran ..... B21B 43/02 198/774.4
4,453,915 A * 6/1984 Finke ..... F27B 9/201 432/11
4,585,411 A * 4/1986 Bocci ..... B65G 25/02 198/463.5
4,687,092 A * 8/1987 Ray ..... B65G 47/31 198/459.1
5,282,742 A * 2/1994 Ellringmann ..... F27B 9/201 414/525.9
9,127,887 B2 * 9/2015 Alfieri ..... B65G 25/02

FOREIGN PATENT DOCUMENTS

JP 58-151659 * 11/1983
JP 60026614 A * 2/1985
JP 60-236007 A 11/1985
JP 08283832 A * 10/1996
JP 10-081916 A 3/1998
JP 2000-017325 A 1/2000
JP 2003-129126 A 5/2003

OTHER PUBLICATIONS

International Search Report of PCT/JP2013/050357, mailing date of Apr. 16, 2013.
Written Opinion of PCT/JP2013/050357, maiiling date of Apr. 16, 2013.

* cited by examiner

WALKING-BEAM TYPE HEATING FURNACE

TECHNICAL FIELD

The present invention relates to a walking-beam type heating furnace in which fixed beams for retaining workpieces fed into the heating furnace are laid in a furnace length direction and in which walking beams for sequentially transferring the workpieces on the fixed beams from an inlet area toward an outlet area are laid in the furnace length direction. Particularly, the invention has the following features. Even when elongate workpieces, such as steel pipe, which are transferred by the walking beams in a direction crossing a longitudinal direction of the workpiece, become curved in an inlet area for heating the workpieces fed into the heating furnace, it is ensured that the walking beams properly transfer the elongate workpieces to the outlet area of the furnace without allowing the curved workpieces to collide against or overlap with each other, and that the curved workpieces are adequately corrected for the curving in the outlet area where the heated workpieces are wholly heated to a uniform temperature and retained in position.

BACKGROUND ARTS

In conventional heating furnaces, a variety of workpieces are continuously heat treated by sequentially transferring the workpieces. As such a heating furnace, the walking-beam type heating furnace is widely used in which the workpieces retained on the fixed beams are heat treated as sequentially transferred by the walking beams performing walking motion.

It is a general practice in such a walking-beam type heating furnace that the fed workpieces are heated in a heating zone of the inlet area while the heated workpieces are wholly heated to the uniform temperature and retained in position in a soaking zone of the outlet area.

In this walking-beam type heating furnace, the elongate workpieces, placed in the direction crossing the transfer direction, are retained on the fixed beams and heat treated as transferred by the walking beams. For this operation, the fixed beams and the walking beams are each formed with corrugated concaves having the same groove depth and pitch in the transfer direction. The walking beams are driven into the walking motion so as to sequentially transfer the workpieces retained in the concaves of the fixed beams to the downstream concaves of the fixed beams in the transfer direction, as allowing the workpieces to be heated.

However, when the elongate workpieces are heat treated as transferred by the walking beams, heating temperature difference occurs in the heating zone of the inlet area between place close to a burning area and place far away from the burning area, so that the elongate workpieces are not uniformly heated, bulgingly curving in the direction crossing the longitudinal direction thereof. Specifically, when the workpiece is fed into the heating furnace, a door is opened to allow the outside air to flow into the furnace. Therefore, the temperature in the heating zone is lower at an upstream side (inlet side) in the transfer direction of the workpiece than at a downstream side (where the burning area exists). Accordingly, a downstream side of the workpiece in the transfer direction of the workpiece is raised to a higher temperature than an upstream side thereof and elongates more by heat. This results in curving of the workpiece. Particularly, in a case where the elongate workpiece is a tubular member as exemplified by steel pipe or the like which has small diameter and thickness, the curving of workpiece due to the heating temperature difference increases. This leads to a problem that the workpieces in the individual concaves, colliding against or overlapping with each other, cannot be properly transferred or adequately heat treated.

In this connection, Patent Document 1 proposes that in at least either one of the fixed beam and the walking beam, a carrying surface on which a workpiece having a circular section is placed is partially formed with a slope to allow the workpiece to roll down by its own weight and rotate through a predetermined angle and that the concaves on the fixed beam have a different pitch from a drive pitch of the walking beam. It is thus ensured that the workpiece is allowed to roll on this slope so as to be uniformly heated while the workpiece is heat treated as transferred by the walking beam. Thus, the workpiece is prevented from bulgingly curving in the direction crossing the longitudinal direction thereof.

However, even though the carrying surface on which the workpiece having the circular section is placed is partially formed with the slope to allow the workpiece to roll down by its own weight and rotate through a predetermined angle, if the workpiece becomes significantly curved shortly after fed into the furnace, the workpiece is incapable of smooth rolling. In the heating zone of the inlet area, the workpiece is not assuredly prevented from curving. There still exists the problem that the workpieces, colliding against or overlapping with each other, cannot be properly transferred and adequately heat treated. There are other problems that the above slope formed on the carrying surface must be increased in length in order to prevent the curving of the workpiece by allowing the workpiece to roll, and that the heating furnace must be increased in length in order to achieve uniform heat treatment of the workpieces by adequately heating the workpieces in the heating furnace.

Further, Patent Document 2 proposes that when the workpieces composed of steel pipe are heat treated as transferred on a roller conveyor, a curving condition of the steel pipe pieces being transferred is sensed to exclude a significantly curved steel pipe piece.

However, the arrangement of Patent Document 2 cannot prevent the curved workpieces from colliding against or overlapping with each other when the curved workpieces are transferred. In addition, a large number of workpieces are wasted because the significantly curved steel pipe pieces are excluded.

CITATION LIST

Patent Document

[Patent Document 1] JP-A-2000-17325
[Patent Document 2] JP-A-S60-236007

DISCLOSURE OF THE INVENTION

Problems to Be Solved by the Invention

In the walking-beam type heating furnace in which the fixed beams for retaining the workpieces fed into the heating furnace are laid in the furnace length direction, and the walking beams for sequentially transferring the workpieces on the fixed beams from the inlet area toward the outlet area are laid in the furnace length direction, the present invention has an object to solve the above-described problems encountered when the elongate workpieces such as steel pipe, placed in the direction crossing the transfer direction, are heat treated as transferred by the walking beams.

Specifically, the object of the invention is to ensure that even when the elongate pieces such as steel pipe, transferred by the walking beams in the direction crossing the longitudinal direction thereof, become curved in the inlet area where the workpieces fed into the heating furnace are heated, the elongate workpieces are properly transferred to the outlet area by the walking beams without colliding against or overlapping with each other and that the curved workpieces are adequately corrected for the curving in the outlet area where the heated workpieces are wholly heated to the uniform temperature and retained in position.

Means for Solving the Problems

According to the invention for solving the above-described problems, a walking-beam type heating furnace includes fixed beams which retain workpieces fed into the heating furnace and are laid in a furnace length direction, and walking beams which sequentially transfer the workpieces on the fixed beams from an inlet area to an outlet area and are laid in the furnace length direction, and has a structure wherein for the walking beams to transfer the elongate workpieces in a direction crossing a longitudinal direction of the workpiece, concaves to retain the above elongate workpieces are formed at least on the walking beams, and wherein the concaves on the walking beams in the inlet area for heating the workpieces fed into the heating furnace are increased in width in the transfer direction while the concaves on the walking beams in the outlet area allowing the heated workpieces to be wholly heated to a uniform temperature and retained in position are formed in a corrugated configuration.

In the case where the concaves on the walking beams in the inlet area for heating the workpieces fed into the heating furnace are increased in width in the transfer direction, the workpieces hardly roll if the above-described elongate workpieces become significantly curved in the inlet area. Thus, the elongate workpieces in the individual concaves are properly transferred by the walking beams to the outlet area without colliding against or overlapping with each other. When the workpieces, as hardly allowed to roll, are sequentially transferred in the heating furnace in this manner, upstream sides of the workpieces in the transfer direction are also heated and raised in temperature. Thus, the upstream sides of the workpieces in the transfer direction gradually elongate by heat and hence, the curving of the workpieces is gradually corrected.

When the workpieces are fed into the outlet area, the workpieces corrected for the curving to some extent are transferred as allowed to roll in the corrugated concaves formed on the outlet-side walking beams. The workpieces are wholly heated to the uniform temperature and retained in position in this outlet area so that the curving of the workpieces is more adequately corrected in this outlet area.

An elongate tubular member such as steel pipe or an elongate rod member, for example, is used as the above-described workpiece. The walking-beam type heating furnace according to the invention, in particular, is suitable for heat treating a workpiece composed of an elongate tubular member, such as steel pipe, which has small diameter and thickness and is liable to curve by one-sided heating in the inlet area.

In the inlet area for heating the workpieces fed into the heating furnace, as described above, the above-described workpieces are transferred as retained in the concaves of the walking beams which are increased in the width in the transfer direction. In this case, the concaves on the walking beams in the inlet area which are increased in the width in the transfer direction may preferably have a flat bottom such as to prevent the workpieces retained in the concaves from rolling to collide against other workpieces retained in the adjoining concaves.

On the other hand, in the outlet area where the heated workpieces are wholly heated to the uniform temperature and retained in position, the walking beams are formed with the corrugated concaves, as described above. If these concaves are formed in a V-groove configuration, the above workpiece makes contact with the opposite sides of the V-grooved bottom. If the workpiece encounters scale formation by contact with the concave, this scale is allowed to fall into the V-grooved bottom so as to be prevented from adhering to the workpiece.

It is preferred in the above walking-beam type heating furnace that the above walking beams are divided into the inlet-side walking beam and the outlet-side walking beam, that a pitch between the concaves formed on the outlet-side walking beam is smaller than a pitch between the concaves formed on the inlet-side walking beam, and that a distance that the outlet-side walking beam reciprocally moves in the transfer direction of the workpiece is shorter than a distance that the inlet-side walking beam reciprocally moves in the transfer direction of the workpiece. In this arrangement, the elongate workpieces are retained in and sequentially transferred to the concaves of the walking beams with the greater pitch in the inlet area where the workpieces are heated. Even when the elongate workpieces are significantly curved, the curved workpieces are more assuredly prevented from colliding against or overlapping with each other. In the outlet area where the workpieces are wholly heated to the uniform temperature and retained in position, the above workpieces are retained in and progressively transferred to the concaves of the walking beams with the smaller pitch. Even though the outlet area is not increased in length, the outlet area ensures that the above workpieces are wholly heated to the uniform temperature and substantially retained in position. Thus, the curved workpieces are adequately corrected for the curving in this outlet area.

It is preferred in the above walking-beam type heating furnace that the fixed beams are also formed with the above-described concaves to retain the workpieces in order to prevent the above workpieces from freely rolling on the fixed beams to collide against or overlap with each other when the above walking beams sequentially transfer the workpieces on the fixed beams from the inlet area toward the outlet area.

The above-described concaves to retain the workpieces may preferably be formed on the fixed beams as follows. In order to prevent the workpieces retained on the fixed beams from rolling to collide against the adjoining workpieces in the inlet area for heating the workpieces fed into the heating furnace and to ensure that the workpieces transferred onto the outlet-side fixed beams by the above walking beams are allowed to roll in the concaves formed on the fixed beams so that the curved workpieces may be wholly heated to the uniform temperature and retained in position in this outlet area, the concave formed on the inlet-side fixed beam allowing for the heating of the workpiece fed into the heating furnace and the concave formed on the outlet-side fixed beam allowing the heated workpiece to be wholly heated to the uniform temperature and retained in position are in correspondence to the above-described concaves formed on the walking beams, respectively.

Effects of the Invention

In the walking-beam type heating furnace according to the invention, for the elongate workpieces to be transferred by the walking beams in the direction crossing the longitudinal direction of the workpiece, as described above, the concaves formed on the walking beams in the inlet area for heating the workpieces fed into the heating furnace are increased in the width in the transfer direction. Therefore, even when the above elongate workpieces become significantly curved in the inlet area, the curved elongate workpieces are properly transferred by the waking beams to the outlet area without colliding against or overlapping with each other.

When the curved workpieces are fed into the outlet area in this manner, the above workpieces are allowed to roll in the corrugated concaves formed on the outlet-side walking beams. Thus, the curved workpieces are wholly heated to the uniform temperature and retained in position in this outlet area. The curving of the workpieces is adequately corrected in this outlet area.

Therefore, when the walking-beam type heating furnace according to the invention is used to heat treat the elongate workpieces, such as steel pipe, as transferring the workpieces in the direction crossing the longitudinal direction of the workpiece by means of the walking beams, it is ensured that even though the elongate workpieces become curved in the inlet area for heating the workpieces, the curved elongate workpieces are properly transferred to the outlet area without colliding against or overlapping with each other. In addition, the curved workpieces are adequately corrected for the curving in the outlet area so that the elongate workpieces can be heat treated properly.

BEST MODES FOR CARRYING OUT THE INVENTION

A walking-beam type heating furnace according to an embodiment of the invention will hereinbelow be described in detail with reference to the accompanying drawings. It is to be noted that the walking-beam type heating furnace according to the invention is not limited to the following embodiments and the invention can be carried out in various ways without departing from the spirit and scope of the invention.

Figure 1:
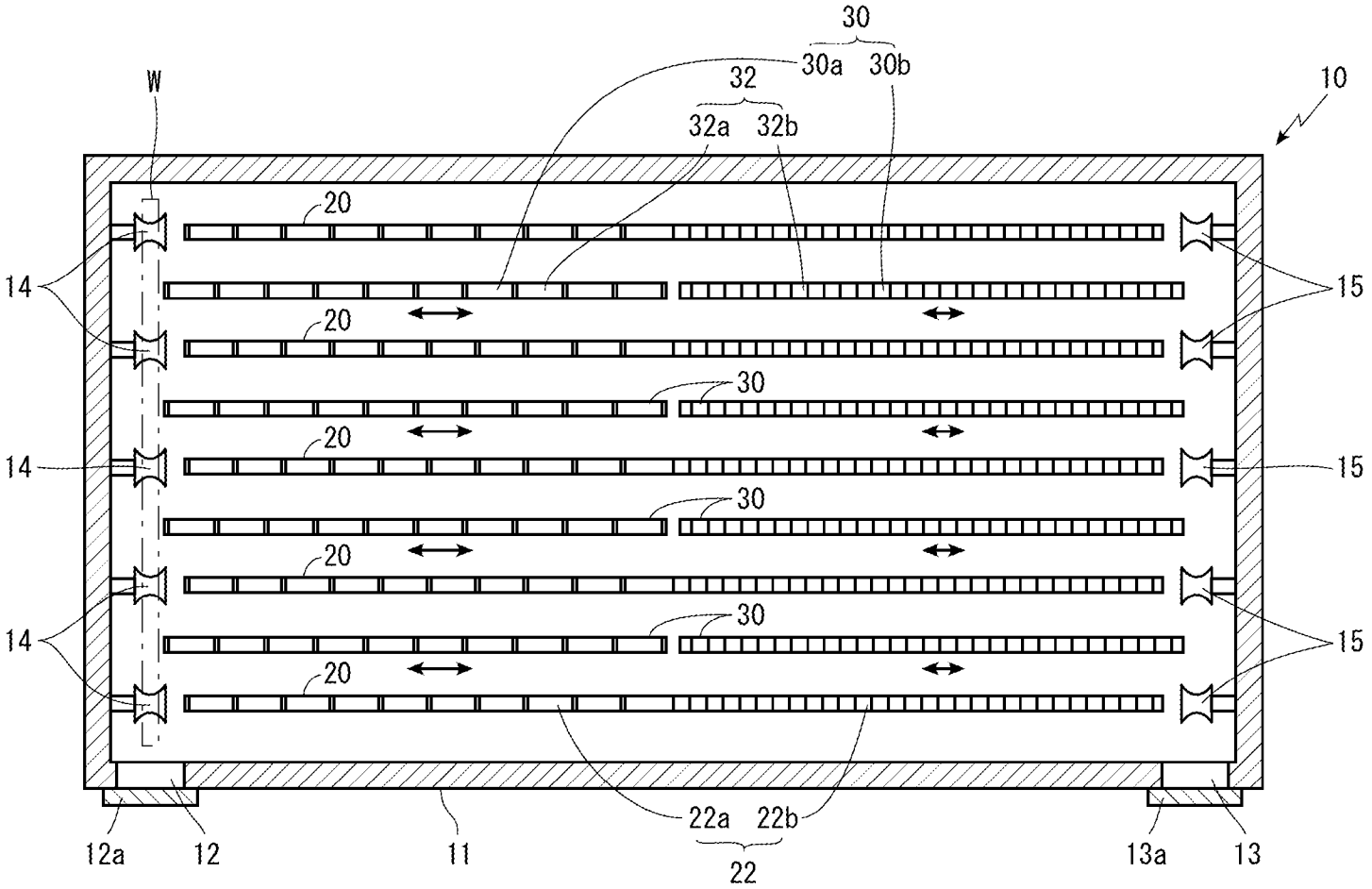
FIG. 1 is a schematic cross-sectional view of a walking-beam type heating furnace according to one embodiment of the invention taken along the longitudinal line of the furnace.

In a walking-beam type heating furnace of the embodiment, as shown in FIG. 1, an inlet port 12 that allows a workpiece W composed of an elongate tubular member such as steel pipe into a heating furnace 10 is provided at an end of a side wall 11 of the heating furnace 10 in a furnace length direction, and an outlet port 13 for discharging the heat-treated workpiece W from the heating furnace 10 is provided at the other end of the side wall in the furnace length direction. The inlet port 12 and outlet port 13 are provided with opening and closing doors 12*a*, 13*a*, respectively.

Carrying-in rollers 14 are provided at an area where the above-described workpiece W is fed into the heating furnace 10 in a longitudinal direction of the workpiece through the above inlet port 12. Further, carrying-out rollers 15 are provided at an area where the heat-treated workpiece W is discharged from the heating furnace 10 in the longitudinal direction of the workpiece through the above outlet port 13.

Figure 2:
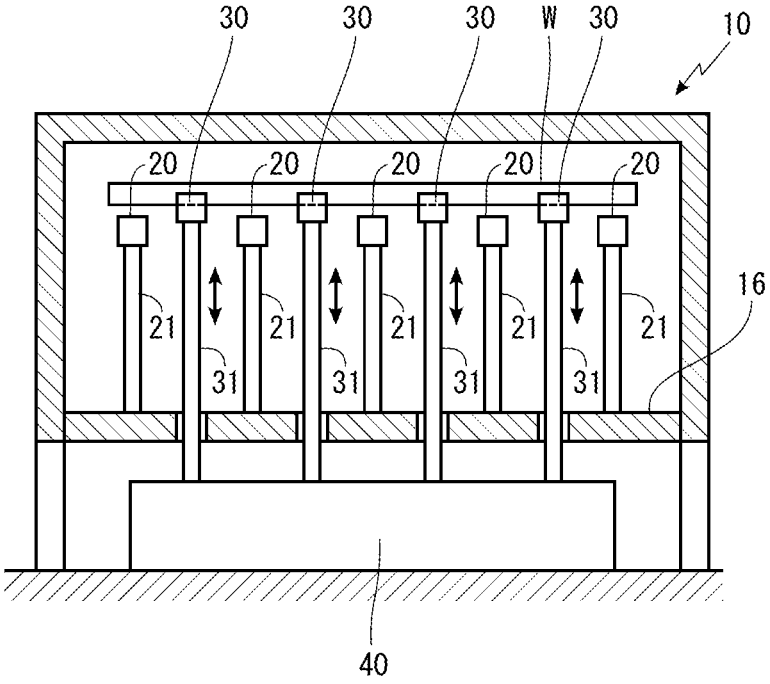
FIG. 2 is a schematic vertical sectional view of the walking-beam type heating furnace of the above embodiment taken along the width line of the furnace.

In this heating furnace 10, as shown in FIG. 1 and FIG. 2, a plurality of fixed beams 20 extending in a furnace length direction, or a transfer direction of the workpiece W, are mounted on fixing supports 21 standing upright on a hearth 16 and are juxtaposed in a furnace width direction with required spacing. Further, a plurality of walking beams 30 extending in the transfer direction of the workpiece W are mounted on driving supports 31 extending upward through the hearth 16 from walking-beam driving means 40 disposed under the hearth 16 and are juxtaposed in the furnace width direction with the required spacing.

The individual walking beams 30 described above are driven into walking motion by the walking-beam driving means 40. Specifically, the walking beams 30 are reciprocally moved in the vertical direction and the transfer direction of the workpiece W so that the workpieces W fed into the heating furnace 10 are sequentially transferred on the fixed beams 20 from an inlet area at the inlet port 12 to an outlet area at the outlet port 13.

Figure 3:
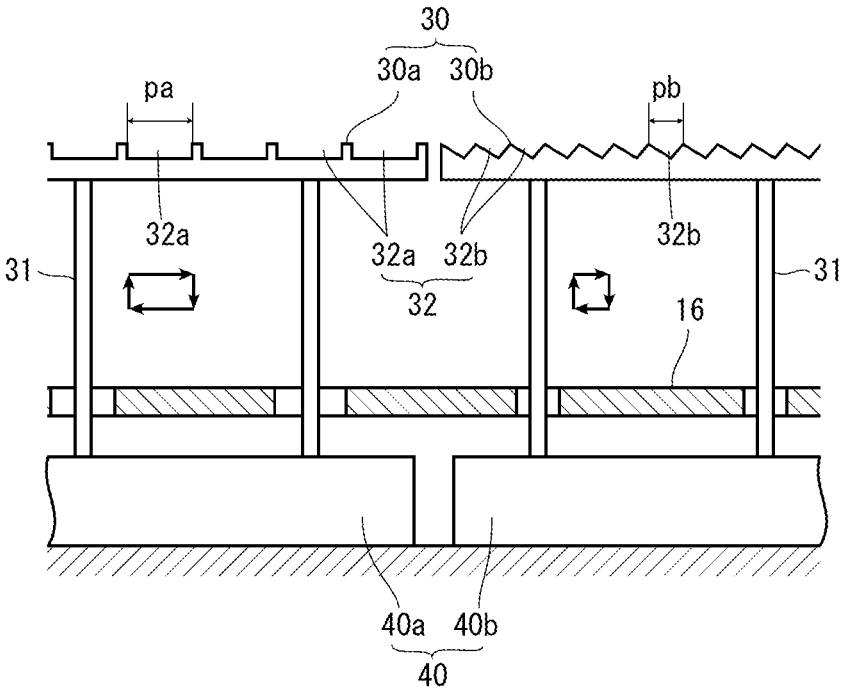
FIG. 3 is a fragmentary explanatory diagram of the walking-beam type heating furnace according to the above embodiment in which walking beams are divided into inlet-side walking beams and outlet-side walking beams, and concaves formed on the inlet-side walking beams and concaves formed on the outlet-side walking beams have different configurations.

For the workpieces W composed of the elongate tubular member such as steel pipe to be sequentially transferred on the fixed beams 20 by the above walking beams 30, concaves 22, 32 for retaining the workpieces W are formed on the above-described fixed beams 20 and walking beams 30 respectively and are arranged in the transfer direction of the workpiece W. In this embodiment, as shown in FIG. 1 and FIG. 3, the above walking beams 30 are divided into an inlet-side walking beam 30*a* that allows the workpiece fed into the heating furnace 10 to be heated, and an outlet-side walking beam 30*b* that allows the heated workpiece to be wholly heated to a uniform temperature and retained in position.

A flat-bottomed concave 32*a* increased in width in the transfer direction is formed on the inlet-side walking beam 30*a* that allows the workpiece W to be heated. On the other hand, a concave 32*b* having a V-groove corrugated configuration is formed on the outlet-side walking beam 30*b* that allows the heated workpiece W to be wholly heated to the uniform temperature and retained in position. A pitch 'pa' between the concaves 32*a* on the inlet-side walking beam 30*a* is greater than a pitch 'pb' between the concaves 32*b* on the outlet-side walking beam 30*b*.

Figure 4:
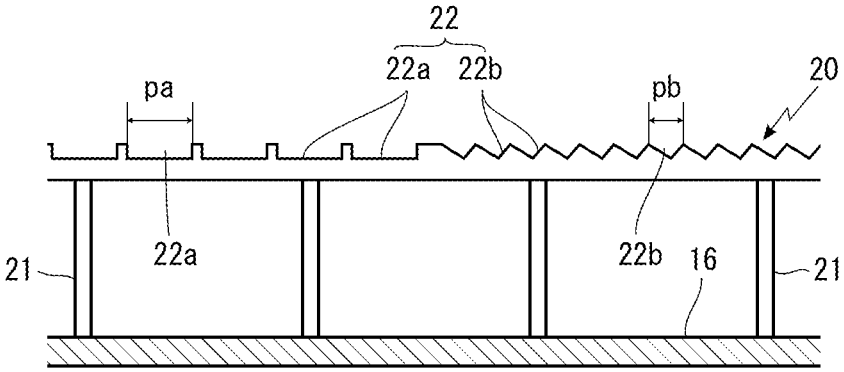
FIG. 4 is a fragmentary explanatory diagram of the walking-beam type heating furnace according to the above embodiment in which concaves formed on inlet-side fixed beams and concaves formed on outlet-side fixed beams have different configurations.

Also on the above-described fixed beam 20, as shown in FIG. 1 and FIG. 4, a flat-bottomed concave 22*a* increased in width in the transfer direction is formed in the inlet area for heating the workpieces W, just as on the above inlet-side walking beam 30*a*. In the outlet area where the heated workpieces W are wholly heated to the uniform temperature and retained in position, on the other hand, a concave 22*b* having a V-groove corrugated configuration is formed just as on the above outlet-side walking beam 30*b*. A pitch 'pa' between the concaves 22*a* on the inlet-side fixed beam 20 is greater than a pitch 'pb' between the concaves 22*b* on the outlet-side fixed beam 20.

The walking-beam driving means 40 for driving the walking beams 30 into the walking motion is divided into one for the inlet-side walking beams 30*a* and one for the outlet-side walking beams 30*b*. The inlet-side walking beams 30*a* are driven into the walking motion by first walking-beam driving means 40*a*. On the other hand, the outlet-side walking beams 30*b* are driven into the walking motion by second walking-beam driving means 40*b*.

A distance that the inlet-side walking beams 30*a* are reciprocally moved by the first walking-beam driving means 40*a* in the transfer direction of the workpiece W is longer than a distance that the outlet-side walking beams 30*b* are reciprocally moved by the second walking-beam driving means 40*b* in the transfer direction of the workpiece W so that the workpieces W in the concaves 32*a* of the inlet-side walking beams 30*a* may be sequentially fed into the concaves 22*a* of the inlet-side fixed beams 20 in an appropriate manner and that the workpieces W in the concaves 32*b* in the outlet-side walking beams 30*b* may be sequentially fed into the concaves 22*b* of the outlet-side fixed beams 20 in an appropriate manner.

Figure 5:
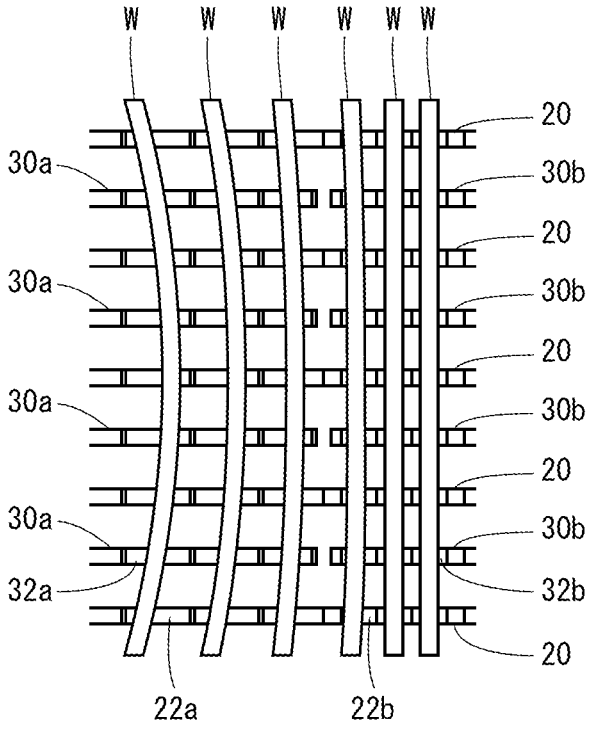
FIG. 5 is a fragmentary explanatory diagram of the walking-beam type heating furnace according to the above embodiment in which workpieces composed of an elongate tubular member are transferred by the walking beams from an inlet area to an outlet area of the heating furnace.

In this manner, the workpieces W composed of the elongate tubular member such as steel pipe are fed into the heating furnace 10 via the inlet port 12 and are sequentially transferred on the fixed beams 20 by the above-described inlet-side walking beams 30*a* and outlet-side walking beams 30*b* in the direction crossing the longitudinal direction of the workpiece W. In this case, as shown in FIG. 5, if the workpieces W in the inlet area become significantly curved in the direction crossing the longitudinal direction thereof due to difference in heating temperatures in the inlet area of the heating furnace 10, the curved workpieces W are properly retained in the flat-bottomed concaves 32*a* of the inlet-side walking beams 30*a* and the flat-bottomed concaves 22*a* of the fixed beams 20 in the inlet area, the concaves 32*a*, 22*a* having the width increased in the transfer direction. Hence, the curved workpieces W are properly transferred to the outlet area without protruding into the adjoining concaves 22*a* to collide against or overlap with the adjoining workpieces W. During the course of transfer of the curved workpieces W to the outlet area, the whole bodies of the above workpieces W so curved are gradually heated so that the workpieces W are gradually decreased in the curving.

The workpieces W thus decreased in the curving are sequentially transferred on the fixed beams 20 in the outlet area by the outlet-side walking beams 30*b*. In this process, the above-described second walking-beam driving means 40*b* transfer the above workpieces W little by little via the narrow-pitched concaves 32*b* on the outlet-side walking beams 30*b* and the narrow-pitched concaves 22*b* on the fixed beams 20 in the outlet area. In addition, the above workpieces W progressively rotate in the V-groove corrugated concaves 32*b* on the outlet-side walking beams 30*b* and the V-groove corrugated concaves 22*b* on the fixed beams 20 in the outlet area, so that the whole bodies of the workpieces W are uniformly heated. The workpieces W are adequately corrected for the curving so as to be properly heat treated. Thus, the heat-treated workpieces W in straightened form can be discharged from the above outlet port 13.

Figure 6:
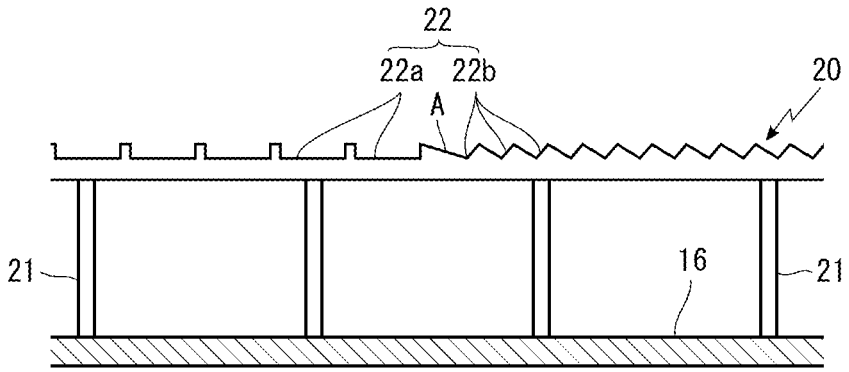
FIG. 6 is a fragmentary explanatory diagram of a fixed beam of the walking-beam type heating furnace according to the above embodiment, on which an outlet-side concave formed in a V-groove corrugated configuration and adjoining an inlet-side flat-bottomed concave increased in width in a transfer direction has an upstream-side slope increased in length.

In order to ensure that the workpiece W retained in the flat-bottomed concave 32*a* of the inlet-side walking beam 30*a*, which is increased in width in the transfer direction, is properly fed into the V-groove corrugated concave 22*b* of the fixed beam 20 in the outlet area, it is preferred in the above embodiment, as shown in FIG. 6, that the V-groove corrugated concave 22*b* of the outlet-side fixed beam 20 which adjoins the flat-bottomed concave 22*a* increased in width in the transfer direction and formed on the inlet-side fixed beam 20 has an upstream-side slope A increased in length.

Figure 7:
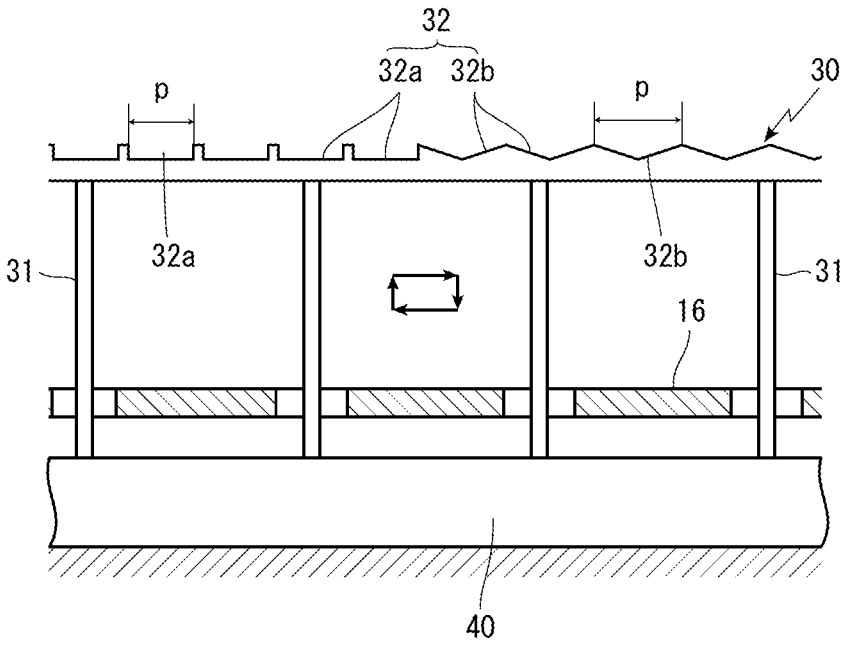
FIG. 7 is a fragmentary explanatory diagram showing an exemplary modification of the walking-beam type heating furnace according to the above embodiment, in which the walking beam is not divided and the concaves on the inlet side and the outlet side of the walking beam have the same pitch but are only varied in configuration.
Figure 8:
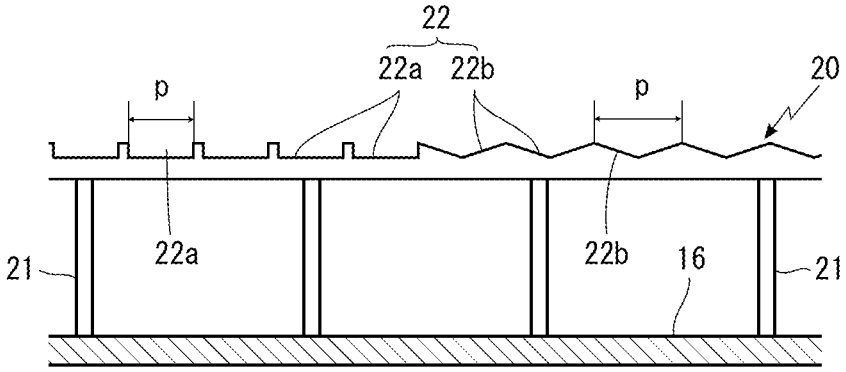
FIG. 8 is a fragmentary explanatory diagram of the walking-beam type heating furnace according to the above exemplary modification, in which the concaves on the inlet side and the outlet side of the fixed beam have the same pitch but are only varied in configuration.

In the walking-beam type heating furnace according to the above embodiment, the walking beams 30 are divided into the inlet-side walking beam 30*a* and the outlet-side walking beam 30*b* and the pitch 'pa' between the concaves 32*a* on the inlet-side walking beam 30*a* is greater than the pitch 'pb' between the concaves 32*b* on the outlet-side walking beam 30*b*. Alternatively, as shown in FIG. 7, the walking beams 30 may not be divided while the concaves 32*a*, 32*b* formed on the inlet side and the outlet side of the walking beam 30 may have the same pitch 'p'. Only the configuration may be varied between the concaves 32*a*, 32*b* on the inlet side and outlet side of this walking beam 30. Further, the walking beams 30 may be driven into the walking motion by one walking-beam driving means 40. In this case, as shown in FIG. 8, the concaves 22*a*, 22*b* formed on the inlet side and the outlet side of the fixed beam 20 may have the same pitch 'p' but be varied only in the configuration so as to correspond to those of the above walking beam 30.

In the case where the heating furnace has this structure, the walking-beam driving means 40 can be unified because there is no need for providing the first walking-beam driving means 40*a*, the second walking-beam driving means 40*b* and the mechanism for varying the distance of reciprocal movement of the walking beam 30 in the transfer direction of the workpiece W between the inlet-side walking beam 30*a* and the outlet-side walking beam 30*b*. In this structure, however, the workpiece W in the outlet area of the heating furnace 10 is transferred at the same pitch as in the inlet area. It is therefore preferred to take a measure such as to increase the length of the outlet area of the heating furnace 10 in order to secure adequate time to achieve uniform heating of the workpieces W.

REFERENCE SIGNS LIST

10: HEATING FURNACE
11: SIDE WALL
12: INLET PORT, 12*a*: OPENING AND CLOSING DOOR

13: OUTLET PORT, 13*a*: OPENING AND CLOSING DOOR
14: CARRYING-IN ROLLER
15: CARRYING-OUT ROLLER
16: HEARTH
20: FIXED BEAM
21: FIXING SUPPORT
22: CONCAVE, 22*a*: INLET-SIDE CONCAVE, 22*b*: OUTLET-SIDE CONCAVE, A: SLOPE
30: WALKING BEAM, 30*a*: INLET-SIDE WALKING BEAM, 30*b*: OUTLET-SIDE WALKING BEAM
31: DRIVING SUPPORT
32: CONCAVE, 32*a*: INLET-SIDE CONCAVE, 32*b*: OUTLET-SIDE CONCAVE
40: WALKING-BEAM DRIVING MEANS, 40*a*: FIRST WALKING-BEAM DRIVING MEANS, 40*b*: SECOND WALKING-BEAM DRIVING MEANS
p: PITCH BETWEEN CONCAVES, pa: PITCH BETWEEN INLET-SIDE CONCAVES, pb: PITCH BETWEEN OUTLET-SIDE CONCAVES
W: WORKPIECE

The invention claimed is:

1. A walking-beam type heating furnace comprising fixed beams which retain workpieces fed into the heating furnace and are laid in a furnace length direction, and walking beams which sequentially transfer said workpieces on the fixed beams from an inlet area to an outlet area and are laid in the furnace length direction, wherein for said walking beams to transfer elongate workpieces placed in a direction crossing a transfer direction, concaves to retain said elongate workpieces are formed at least on said walking beams, and wherein the concaves on the walking beams in the inlet area for heating the workpieces fed into the heating furnace have a flat horizontal bottom surface with two vertical sides and are increased in width in the transfer direction to ensure that a workpiece curved in the transfer direction crossing the longitudinal direction thereof is out of contact with a workpiece retained in the adjoining concave, while the concaves on the walking beams in the outlet area allowing the heated workpieces to be wholly heated to a uniform temperature and retained in position are formed in a corrugated configuration.

2. The walking-beam type heating furnace according to claim 1, wherein said workpiece is an elongate tubular member.

3. The walking-beam type heating furnace according to claim 1, wherein the concave formed on said inlet-side walking beam has a greater width in the transfer direction than that of the concave formed on said outlet-side walking beam.

4. The walking-beam type heating furnace according to claim 1, wherein the corrugated concave formed on said outlet-side walking beam has a V-groove corrugated configuration.

5. The walking-beam type heating furnace according to claim 1, wherein a pitch between the concaves formed on said outlet-side walking beam is smaller than a pitch between the concaves formed on said inlet-side walking beam, and wherein a distance that the outlet-side walking beam reciprocally moves in the transfer direction of the workpiece is shorter than a distance that the inlet-side walking beam reciprocally moves in the transfer direction of the workpiece.

6. The walking-beam type heating furnace according to claim 1, wherein said fixed beams are formed with concaves to retain said workpieces, and wherein the concave formed on the fixed beam in the inlet area for heating the workpiece fed into the heating furnace and the concave formed on the fixed beam in the outlet area allowing the heated workpiece to be wholly heated to the uniform temperature and retained in position are in correspondence to the concaves formed on said walking beams.

* * * * *